US009521932B2

(12) United States Patent
Donatelli

(10) Patent No.: US 9,521,932 B2
(45) Date of Patent: Dec. 20, 2016

(54) WALL MOUNTED BODY CLEANING SYSTEM

(71) Applicant: Frederick Donatelli, Londonderry, NH (US)

(72) Inventor: Frederick Donatelli, Londonderry, NH (US)

( * ) Notice: Subject to any disclaimer, the term of this patent is extended or adjusted under 35 U.S.C. 154(b) by 38 days.

(21) Appl. No.: 14/641,704

(22) Filed: Mar. 9, 2015

(65) Prior Publication Data

US 2016/0262578 A1 Sep. 15, 2016

(51) Int. Cl.
*A47K 7/02* (2006.01)
*A47K 7/04* (2006.01)

(52) U.S. Cl.
CPC ..... *A47K 7/046* (2013.01); *A47K 7/024* (2013.01)

(58) Field of Classification Search
CPC ..... A47K 7/024
USPC ..... 4/596–614
See application file for complete search history.

(56) References Cited

U.S. PATENT DOCUMENTS 3,074,088 A * 1/1963 Williams ..... A46B 13/06 15/29
3,869,746 A * 3/1975 Man-king ..... A61C 17/38 15/29
4,151,623 A 5/1979 Steere
4,155,137 A * 5/1979 Kadlub ..... A46B 13/06 137/599.11
4,282,623 A * 8/1981 Gacuzana ..... A46B 13/06 15/230.17
D298,291 S 11/1988 Lanier
5,153,962 A * 10/1992 Ritter ..... A46B 13/06 15/28
5,329,650 A * 7/1994 Zaccai ..... E03C 1/0408 4/596
5,561,869 A * 10/1996 Sarel ..... A47K 7/046 4/606
5,774,907 A 7/1998 Doggwiler
6,338,170 B1 * 1/2002 De Simone ..... A46B 13/06 4/606
6,662,386 B1 12/2003 Bowerman
6,775,864 B2 * 8/2004 Cannetti ..... A46B 13/008 15/21.1
7,120,947 B1 * 10/2006 Magallanes ..... A47K 7/024 4/606
8,037,567 B1 10/2011 Harris

FOREIGN PATENT DOCUMENTS

WO WO9522953 8/1995

* cited by examiner

*Primary Examiner* — Lori Baker

(57) ABSTRACT

A wall mounted body cleaning system includes a perimeter wall and a water outlet mounted on the perimeter wall. A mount is positioned on the perimeter wall and a housing is attached to the mount. An impeller is positioned within the housing and the housing has a drain opening therein. A conduit is fluidly coupled to the housing and to the water outlet. Water flowing through the conduit rotates the impeller and exits the housing through a drain in the housing. An axle is attached to the impeller and extends through the housing. A cleaning member is mounted on the axle and is rotated when the impeller rotates.

6 Claims, 5 Drawing Sheets

WALL MOUNTED BODY CLEANING SYSTEM

BACKGROUND OF THE DISCLOSURE

Field of the Disclosure

The disclosure relates to body cleaning devices and more particularly pertains to a new body cleaning device for assisting a person in cleaning areas of the body which are difficult to reach.

SUMMARY OF THE DISCLOSURE

An embodiment of the disclosure meets the needs presented above by generally comprising a perimeter wall and a water outlet mounted on the perimeter wall. A mount is positioned on the perimeter wall and a housing is attached to the mount. An impeller is positioned within the housing and the housing has a drain opening therein. A conduit is fluidly coupled to the housing and to the water outlet. Water flowing through the conduit rotates the impeller and exits the housing through a drain in the housing. An axle is attached to the impeller and extends through the housing. A cleaning member is mounted on the axle and is rotated when the impeller rotates.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
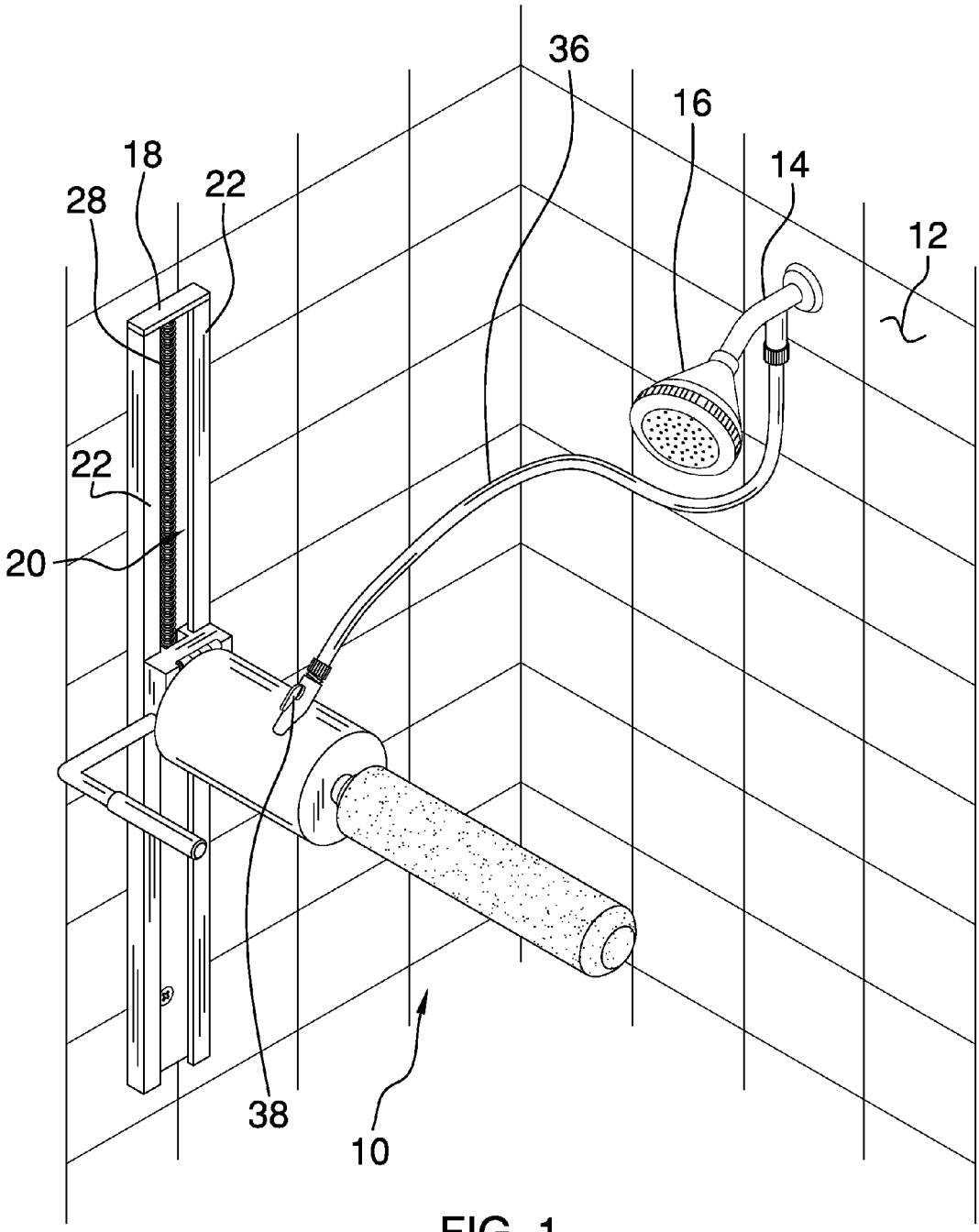
FIG. 1 is a top perspective view of a wall mounted body cleaning system according to an embodiment of the disclosure.
Figure 2:
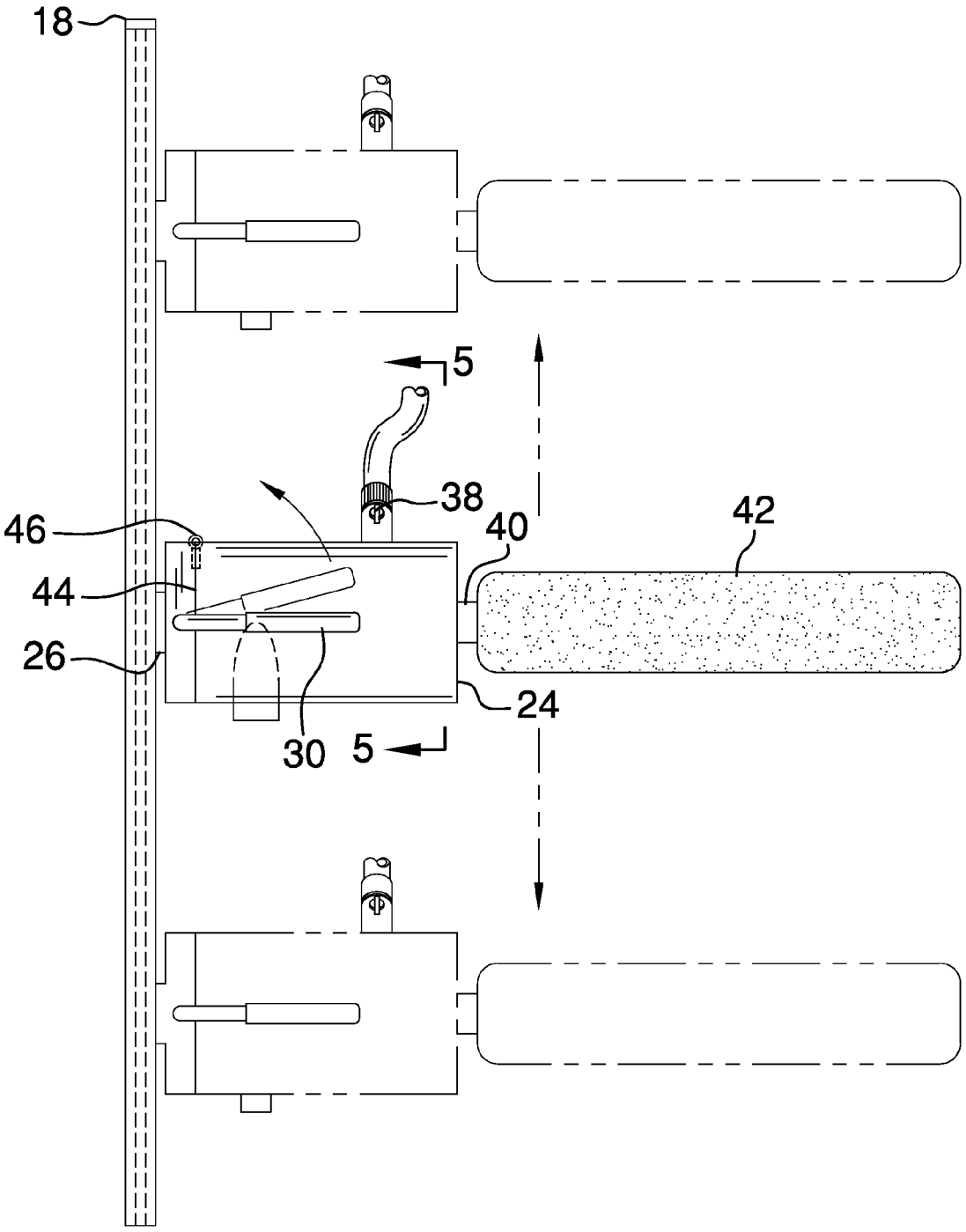
FIG. 2 is a side view of an embodiment of the disclosure.

With reference now to the drawings, and in particular to FIGS. 1 through 5 thereof, a new body cleaning device embodying the principles and concepts of an embodiment of the disclosure and generally designated by the reference numeral 10 will be described.

As best illustrated in FIGS. 1 through 5, the wall mounted body cleaning system 10 generally comprises a perimeter wall 12. The perimeter wall 12 may be any typical wall which is adjacent to or partially surrounds a bathing area such as a shower or the like. A water outlet 14 is mounted on the perimeter wall 12 and the water outlet 14 may include a nozzle 16 for supplying water adjacent to the perimeter wall 12. As can be seen in FIG. 1, the water outlet 14 and nozzle 16 may be that conventionally used for showers.

A mount 18 is positioned on the perimeter wall 12 and the mount 18 is vertically elongated. The mount 18 may include an elongated slot 20 therein which is also vertically elongated such that a pair of rails 22 is formed. A housing 24 is attached to the mount 18. The housing 24 may include a coupler 26 that extends into the slot 20 and engages the rails 22, which may in turn include catches, not shown, for engaging the mount 18. The coupler 26 may alternatively simply frictionally engage the mount 18 such the downward and outward force of the housing 24 causes the mount 18 to engage the rails 22, and/or the housing 24, coupler 26 and articles on the housing 24 may be weight balanced against a spring 28 used to assist in raising the housing 24. The housing 24 is movable on the mount 18 between an upper end and a lower end of the mount 18 and a handle 30 is attached to the coupler 26 to facilitate its movement. This arrangement allows a user to move the housing 24 vertically depending on which part of their body they are cleaning.

An impeller 32 is positioned within the housing 24 and the housing 24 has a drain opening 34 therein. A conduit 36 is fluidly coupled to the housing 24 and to the water outlet 14. Water flowing through the conduit 36 rotates the impeller 32 and exits the housing 24 through the drain 34. A valve 38 may be fluidly coupled to the conduit 36 and is actuated to an open condition or a closed condition. Thus water flow to the impeller 32 may be allowed or cut off as desired. An axle 40 is attached to the impeller 32 and extends through the housing 24. The axle 40 has an axis of rotation that extends through the mount 18 such that the axis of rotation is generally perpendicular to a portion of the perimeter wall 12 to which the mount is attached.

A cleaning member 42 is mounted on the axle 40. The cleaning member 42 may have a tubular shape and has a longitudinal axis that is co-linear with the longitudinal axis of the axle 40. The cleaning member 42 may be comprised of a sponge material which is either a natural or synthetic material.

Figure 3:
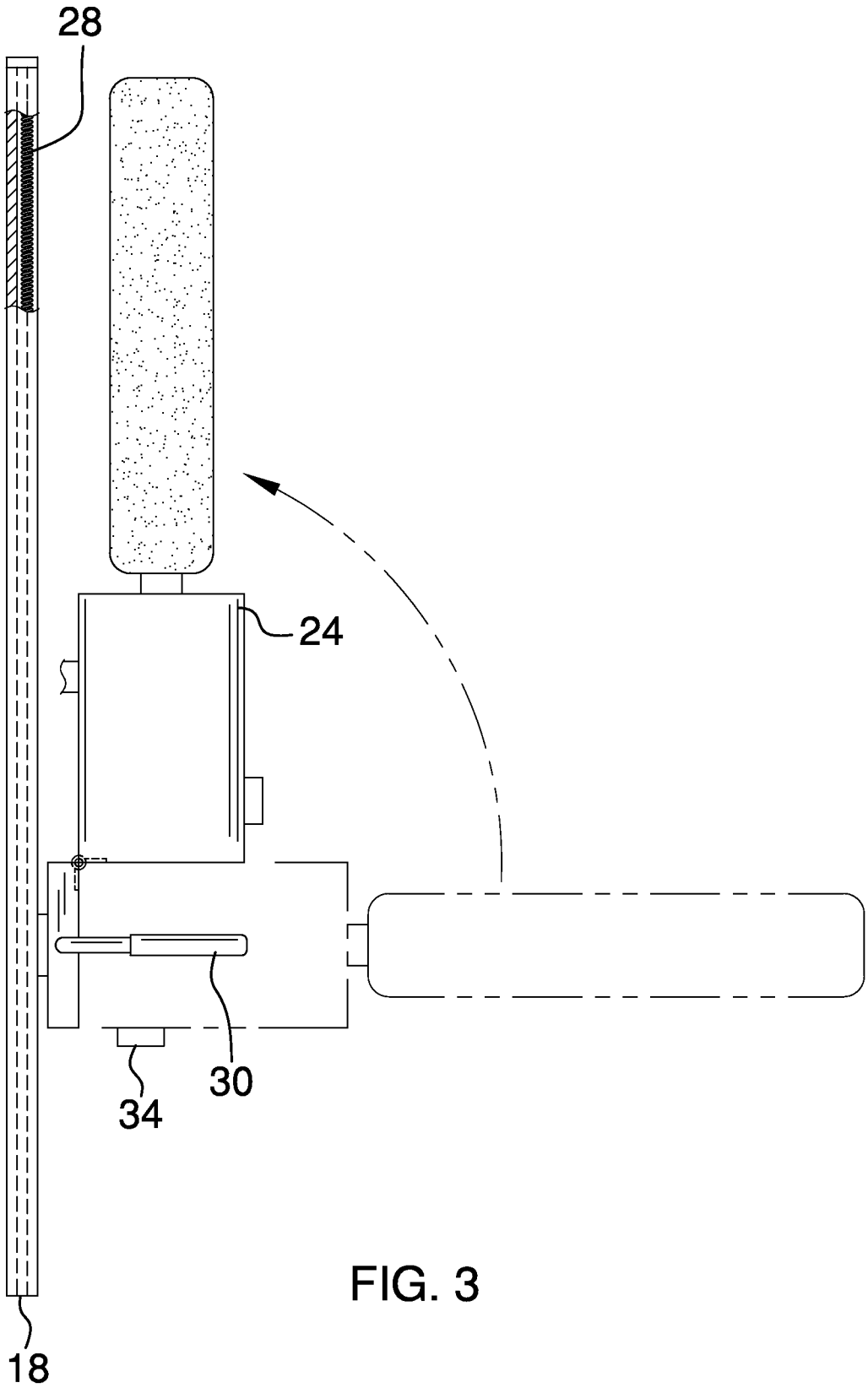
FIG. 3 is a side view of an embodiment of the disclosure.
Figure 4:
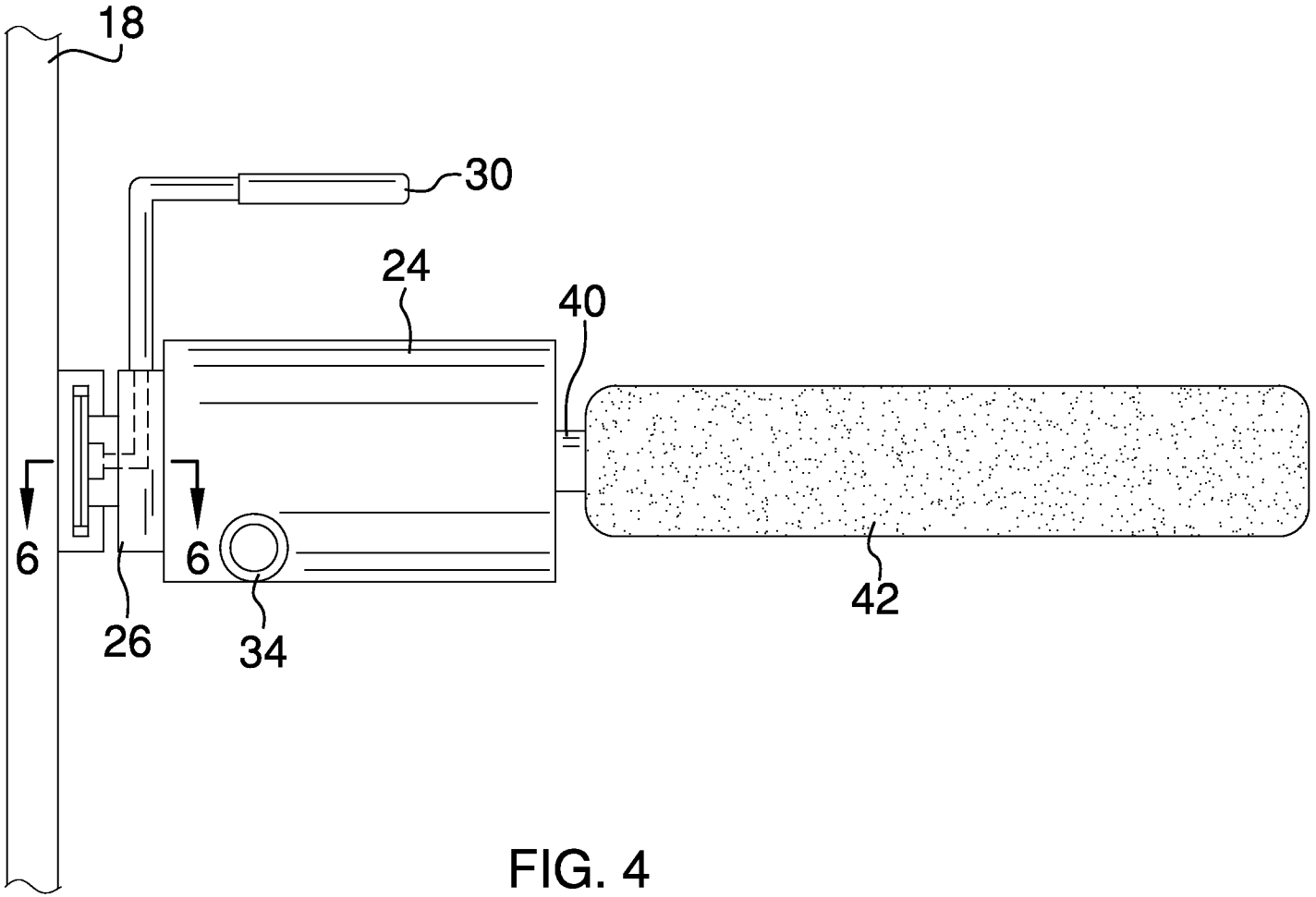
FIG. 4 is a bottom view of an embodiment of the disclosure.
Figure 5:
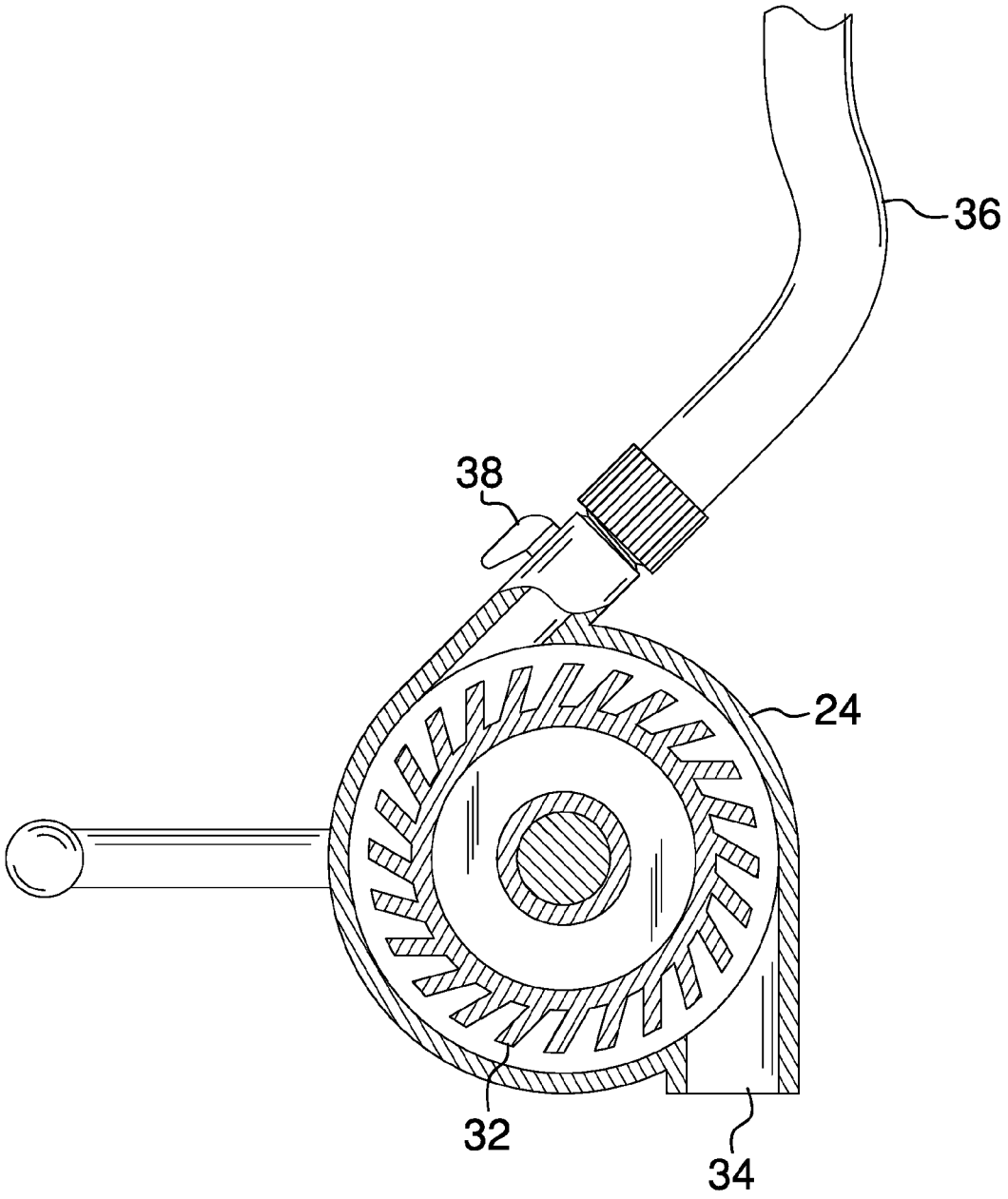
FIG. 5 is a cross-sectional view of an embodiment of the disclosure taken along line 5-5 of FIG. 2

In use, the user may use the cleaning member 42, as needed, to clean various portions of their body and in particular those portions which are difficult to reach such as the back. The impeller 32 rotates the axle 40 and the cleaning member 42 so that the cleaning member 42 rotates and cleans the skin against which it is abutted. The cleaning member 42 may be removable for changing as needed. The housing 24, and or coupler 26, may include a break 44 therein between with a hinge 46 along a shared upper surface to allow the housing 24 to be rotated upwardly, out of the way, when it is not being used as is shown in FIG. 3.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A body cleaning system comprising:

a perimeter wall;

a water outlet being mounted on said perimeter wall;

a mount being positioned on said perimeter wall, said mount being vertically elongated, a housing being movable on said mount between an upper end and a lower end of said mount;

a housing being attached to said mount;

an impeller being positioned within said housing, said housing having a drain opening therein;

a conduit being fluidly coupled to said housing and to said water outlet, wherein water flowing through said conduit rotates said impeller and exits said housing through said drain in said housing;

an axle being attached to said impeller and extending through said housing; and a cleaning member being mounted on said axle.

2. The body cleaning system according to claim 1, wherein said water outlet includes a nozzle for supplying water adjacent to said perimeter wall.

3. The body cleaning system according to claim 1, further including a valve being fluidly coupled to said conduit, said valve being actuated to an open condition or a closed condition.

4. The body cleaning system according to claim 1, wherein said cleaning member is tubular and has a longitudinal axis being co-linear with said longitudinal axis of said axle.

5. The body cleaning system according to claim 4, wherein said cleaning member is comprised of a sponge material.

6. A body cleaning system comprising:

a perimeter wall;

a water outlet being mounted on said perimeter wall, said water outlet including a nozzle for supplying water adjacent to said perimeter wall;

a mount being positioned on said perimeter wall, said mount being vertically elongated;

a housing being attached to said mount, said housing being movable on said mount between an upper end and a lower end of said mount;

an impeller being positioned within said housing, said housing having a drain opening therein;

a conduit being fluidly coupled to said housing and to said water outlet, wherein water flowing through said conduit rotates said impeller and exits said housing through said drain;

a valve being fluidly coupled to said conduit, said valve being actuated to an open condition or a closed condition;

an axle being attached to said impeller and extending through said housing, said axle having an axis of rotation extending through said mount; and a cleaning member being mounted on said axle, said cleaning member being tubular and having a longitudinal axis being co-linear with said longitudinal axis of said axle, said cleaning member being comprised of a sponge material.

* * * * *